US007488563B2

(12) United States Patent
Rimai et al.

(10) Patent No.: US 7,488,563 B2
(45) Date of Patent: Feb. 10, 2009

(54) ELECTROSTATOGRAPHIC METHOD USING COMPLIANT INTERMEDIATE TRANSFER MEMBER

(75) Inventors: Donald S. Rimai, Webster, NY (US); Biao Tan, Penfield, NY (US); Craig M. Cody, Scottsville, NY (US); Rodney R. Bucks, Webster, NY (US); Charles E. Hewitt, Rochester, NY (US); M. Cristina B. Dejesus, Fairport, NY (US); Paul L. Nielsen, Lima, NY (US); Diane M. Herrick, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 291 days.

(21) Appl. No.: 11/250,224

(22) Filed: Oct. 14, 2005

(65) Prior Publication Data

US 2007/0087283 A1 Apr. 19, 2007

(51) Int. Cl.
*G03G 15/16* (2006.01)

(52) U.S. Cl. ..... 430/123.51; 430/125.32; 399/167

(58) Field of Classification Search ..... 430/123.51, 430/125.32; 399/167
See application file for complete search history.

(56) References Cited

U.S. PATENT DOCUMENTS 4,737,433 A 4/1988 Rimai et al.
5,084,735 A 1/1992 Rimai et al.
5,087,393 A * 2/1992 Guest et al. ..... 399/167
5,370,961 A 12/1994 Zaretsky et al.
5,689,787 A 11/1997 Tombs et al.
5,728,496 A 3/1998 Rimai et al.
5,807,651 A 9/1998 Rimai et al.
5,821,972 A 10/1998 Mey et al.
5,835,832 A 11/1998 Rimai et al.
5,968,656 A 10/1999 Ezenyilimba et al.
6,677,095 B2 * 1/2004 Murota et al. ..... 430/108.3

OTHER PUBLICATIONS

Diamond, Arthur S & David Weiss (eds.) Handbook of Imaging Materials, 2nd ed.. New York: Marcel-Dekker, Inc. (Nov. 2001) p. 187.*

* cited by examiner

*Primary Examiner*—Christopher RoDee
(74) *Attorney, Agent, or Firm*—Carl F. Ruoff

(57) ABSTRACT

The present invention is a method of forming a toner image on a receiving sheet. The method includes forming an electrostatic image on a primary image member and toning the image with a dry toner to form a toner image. The toner includes toner particles having a diameter of between 4 and 10 microns and transfer assisting particles appended to the toner particles surface. The transfer assisting particles have a diameter of between 20 and 100 nm. The toner image is transferred from the primary image member to an intermediate image member having an overcoat layer, the overcoat layer having a Young's modulus of from 250 to 500 MPa. The toner image is transferred from the intermediate image member to a receiving sheet wherein the intermediate image member drives the primary image member or the receiving sheet.

7 Claims, 1 Drawing Sheet

ELECTROSTATOGRAPHIC METHOD USING COMPLIANT INTERMEDIATE TRANSFER MEMBER

FIELD OF THE INVENTION

The invention relates generally to production of images using an electrostatographic process and is also suited for the production of color images.

BACKGROUND OF THE INVENTION

U.S. Pat. No. 5,821,972 describes an electrographic printing apparatus which includes a developer supply for supplying a developer having a toner component; a print head for transferring toner from the developer supply in an image wise manner; and a compliant receiver for receiving the image wise toner from the print head. The receiver has a compliant inner conductive blanket layer for allowing the receiver to conform to a print medium and a non-compliant overcoat layer for efficiently releasing toner from the receiver. The image wise toner is transferred from the compliant receiver to the print medium at a transfer station.

U.S. Pat. No. 5,689,787 describes forming a small particle toner image on a primary image member, such as a photoconductor; electrostatically transferring the image to an intermediate transfer member; and then electrostatically transferring the image to a receiving sheet. The intermediate transfer member includes a substrate, a compliant blanket, and a thin, hard overcoat sectioned into small, discreet segments.

U.S. Pat. No. 5,835,832 (1998) teaches an improved method and apparatus for robust transfer of toner images using toner particles having a volume average diameter between about 2 μm and about 9 μm. Surprisingly good electrostatic transfer is obtained when the surface charge density of the toner is between $3.0\times10^{-9}$ coul/cm$^3$ and $6.5\times10^{-9}$ coul/cm$^3$ and when this toner is used in conjunction with a compliant transfer intermediate.

U.S. Pat. Nos. 5,728,496 and 5,807,651 describe unexpectedly good transfer of electrophotographically-produced images using small toner particles when the image is developed on an electrostatographic recording member, preferably an organic photoconductive element, which has been overcoated with a thin (about 10 nm to about 10 μm thick) layer of a material having a Young's modulus greater than 10 GPa and preferably greater than about 100 GPa. The image is then transferred to an intermediate member which is comprised of an elastomeric blanket between about 0.1 and about 3 cm thick, having a Young's modulus between about 0.5 MPa and about 50 MPa, and preferably between about 1 and about 10 MPa, and having an electrical resistivity between about $10^6$ ohm-cm and about $10^{12}$ ohm-cm, by applying an appropriate electrostatic potential between the transfer intermediate member and the photoconductive element. The toned image is transferred from the intermediate transfer member to the receiver by applying an electrostatic field between the receiver and the intermediate transfer member. The blanket material comprising the intermediate transfer member should be overcoated with a thin (between about 0.1 μm and about 25 μm thick) layer of a material having a Young's modulus greater than about 100 MPa and preferably greater than about 1 GPa.

In an electrostatographic engine such as an electrophotographic engine, an electrostatic latent image is initially formed on a primary imaging member such as a photoreceptor and then developed into a visible image using marking particles, often referred to as toner or dry ink particles. This image is then transferred to a receiver such as paper, generally upon application of an electrostatic field that urges the electrically charged toner particles towards the receiver and the image is then permanently fixed by passing the image-bearing receiver through a fuser that melts the toner particles and permanently fixes them to the receiver. The receiver is transported through the electrophotographic engine using a receiver transport mechanism as is known in the art.

Color images are generally produced by first producing separate electrostatic latent images corresponding to the cyan, magenta, yellow, and black information, toning each of these separations with toner consisting of the correct primary subtractive toner, and then superimposing these separate images on the receiver. Images comprising principally a certain color (e.g. black alphanumeric characters) with a certain localized color such as a corporate logo, could also produce images in a similar manner. In this latter example, however, toners corresponding specifically to those used in the image, rather than process colors comprising the subtractive primary colored toners, are generally used. Transfer is often accomplished by wrapping the receiver around an electrically biasable transfer roller and sequentially transferring the separations, in register, to the receiver by applying an appropriate electrical bias to the transfer roller.

Under certain circumstances, it is advantageous to transfer the toned image first to an intermediate transfer member and then from that intermediate transfer member to the receiver. For example, by transferring the toned color separations to the intermediate, the receiver need not be picked up and wrapped around the transfer roller and then released after transfer. This allows the use of a straight paper path, simplifies the process, and reduces the probability of having a paper jam.

Of particular advantage to enhance the electrostatic transfer of toned images is the use of a compliant intermediate, as disclosed by Rimai et al. (U.S. Pat. No. 5,084,735), wherein a multilayer transfer intermediate comprising a compliant layer having a Young's modulus of $10^7$ Pa or less and a thin outer skin having a Young's modulus of $5\times10^7$ Pa or greater. The advantage of a compliant intermediate over noncompliant intermediates is that it facilitates the transfer of toner particles by allowing the toner particles to contact both the primary imaging member and the receiver, in a manner similar to that disclosed by Rimai and Chowdry in U.S. Pat. No. 4,737,433. It should be noted that U.S. Pat. No. 4,737,433 teaches the use of monodisperse toner particles and very smooth receivers and, therefore, does not directly read on the present invention.

In U.S. Pat. No. 5,370,961, Zaretsky and Gomes disclose the transfer of toner particles having a mean particle diameter of less than 7 μm, said toner particles comprising transfer-assisting particles strongly adhering to the surface of the toner particles, said transfer-assisting particles having a mean particle diameter between 0.01 and 0.2 μm from a compliant intermediate such as that disclosed by Rimai in U.S. Pat. No. 5,084,735, but also restricting that compliant intermediate to one whose average surface roughness is equal to or less than 20% of the mean toner diameter.

Ezenyilimba et al, in U.S. Pat. No. 5,968,656, disclose an outer surface network comprising the cross-linked reaction product between a polyurethane with reactive alkoxysilane moieties and tetraalkoxysilane, hereafter referred to as a ceramer and incorporated by reference into the present disclosure. According to that disclosure, the silicon oxide network comprises between 10 and 80% of the ceramer, preferably between 25 and 65% of the ceramer, and more preferably between 35-50% of the ceramer. Moreover, it is important that the ceramer have a storage modulus between 0.10 and 2.0 GPa and preferably between 0.30 and 1.75 GPa, and more preferably between 1.0 and 1.5 GPa. Ezenyilimba et al. does not teach the use of a compliant intermediate comprising a ceramer with toner particles comprising transfer-assisting particles. In certain electrostatographic or electrophotographic engines (hereafter referred to simply as electrophotographic engines unless otherwise denoted), the primary imaging member is driven by the intermediate transfer member. The intermediate may be directly driven by a motor or other suitable means. Alternatively, the intermediate transfer member may be driven by another member such as the receiver transport member or web. In either case, the use of an intermediate transfer member as a drive member will cause stresses in that member as a result of the torques required to drive the other members. This is especially problematic with compliant intermediates, wherein the relatively low Young's moduli of compliant intermediates, will result in relatively large strains. Such strains can readily cause the overcoat layer of the compliant blanket of the intermediate to crack and craze. These cracks can widen as a result of the stresses resulting from the use of the intermediate transfer member as a drive member, thereby creating image artifacts in the transferred image. Moreover, the occurrence of cracks can cause the overcoat layer to delaminate from the underlying elastomeric blanket, thereby making the roller too adhesive and consequently adversely affecting transfer. As is well known, materials with relatively high Young's moduli tend to crack under lower strain conditions than do materials with lower Young's moduli. Accordingly, the use of a relatively high modulus overcoat, such as those disclosed in the patents by Rimai et al., Zaretsky et al., and Ezenyilimba et al. may not function at all in an electrophotographic engine in which a compliant intermediate member is used to drive another member such as a primary imaging member.

Another constraint on the values allowed for the Young's modulus of the overcoat layer of a compliant intermediate arises from the use of transfer-assisting particles appended to the surface of the toner particles. Specifically, in an ideal world of spherical particles, the force needed to detach a particle from a substrate is independent of the Young's modulus of that substrate. The force needed to detach a toner particle from an intermediate member has a direct bearing on one's ability to either transfer from the primary imaging member to the intermediate transfer member or from the intermediate transfer member to the receiver. In other words, if toner particles are held too strongly to the intermediate transfer member, it becomes difficult to transfer from that member to the receiver. Conversely, if the intermediate transfer member is not sufficiently adhesive, toner may not transfer to that member from the primary imaging member. In the nonideal world of irregularly-shaped toner particles, toner adhesion is often controlled by the interaction of the asperities on the toner with the underlying substrate. While it is not the intention to base the validity of this patent on an explanation of this phenomenon, such an explanation can help elucidate the underlying interactions giving rise to the present invention.

Toner particles interact with substrates such as compliant intermediates, primary imaging members, receivers, and the like by two types of forces. The first comprises long range electrostatic forces arising from the electrostatic charge on the toner particle. The second is the short range van der Waals interactions. Van der Waals interactions are generally significant at separation distances between two bodies of less than 10 nm and tend to increase linearly with the diameter of the particle. For particles the size of toner particles that are typically used today (between approximately 4 and 12 μm), experimental evidence suggests that the dominant mode of interactions arise from van der Waals forces. Accordingly, if a particle has asperities on its surface that separate the bulk of the particle from a substrate by a few nanometers, the force adhering the particle to the substrate would depend on the radius of the substrate, not on the radius of the particle. Accordingly, the role of the transfer-assisting particles that are appended to the surface of the toner particles is to physically separate the toner particles from the underlying substrate such as a primary imaging member or a transfer intermediate member, thereby facilitating transfer of the toner particles from one member to another under the influence of the applied electrostatic transfer field. Ideally, the transfer-assisting particles should have diameters close to approximately 10 nm, which would minimize the force of adhesion between that particle and the contacting substrate without significantly contributing van der Waals forces of adhesion of its own. In reality, the transfer-assisting particles are often somewhat larger, typically between approximately 30 nm and 50 nm. It should be noted that the stated size of the transfer-assisting particles is often the diameter of agglomerates of smaller fundamental particles, but that distinction is not important for this invention.

A difficulty arises when using toner particles comprising transfer-assisting particles appended to the surface of the toner particles with compliant intermediates. If the underlying substrate deforms sufficiently under the stresses associated with the forces of adhesion (including electrostatic) or the applied pressures existing in the transfer nip, the toner particles may become sufficiently engulfed into a compliant intermediate, notwithstanding the presence of the overcoat, so as to totally engulf the transfer assisting particles and thereby negating any influence on transfer that they may have had. At the lower range of values of the Young's modulus of the overcoat, as disclosed in the related art, this can readily occur, as will be shown in this disclosure. Indeed, Zaretsky et al. had to require that the surface of the intermediate transfer member be smooth to minimize this problem. Requiring such smoothness is often difficult in a real-life manufacturing process. Moreover, Zaretsky et al. also allowed the transfer-assisting particles to have diameters as great as 200 nm. As previously discussed, as the size of the transfer-assisting particles increases, their contribution to the adhesion of the toner particles also increases.

It is not obvious from the related art that a compliant intermediate that is capable of transferring toner particles between 4.0 μm and 10.0 μm that can also be used to drive another member or members of an electrophotographic engine could be produced. More specifically, there is no range of values of the Young's modulus of the overcoat, when used with toner particles comprising transfer-assisting particles between approximately 20 nm and 70 nm appended to the surface of the toner particles, could be used also as a drive mechanism in an electrophotographic engine.

SUMMARY OF THE INVENTION

Briefly summarized, the present invention is a method of forming a toner image on a receiving sheet. The method includes forming an electrostatic image on a primary image member and toning the image with a dry toner to form a toner image. The toner includes toner particles having a diameter of between 4 and 10 microns and transfer assisting particles appended to the toner particles surface. The transfer assisting particles have a diameter of between 20 and 100 nm. The toner image is transferred from the primary image member to an intermediate image member having an overcoat layer, the overcoat layer having a Young's modulus of from 225 to 500 MPa. The toner image is transferred from the intermediate image member to a receiving sheet wherein the intermediate image member drives the primary image member or the receiving sheet.

The present invention also describes an apparatus that is capable of forming an electrostatographic image, preferably an electrophotographic image on a receiver sheet. The apparatus comprises a compliant intermediate transfer member that is also used to drive at least one other member of the apparatus. In the preferred mode of operation, the apparatus also comprises dry toner particles having diameters between 4 and 10 microns and transfer assisting particles appended to the surface of the toner particles, said transfer assisting particles having a diameter between 20 and 100 nm. The compliant intermediate transfer member comprises an overcoat layer having a Young's modulus of from 250 to 500 MPa.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

Figure 1:
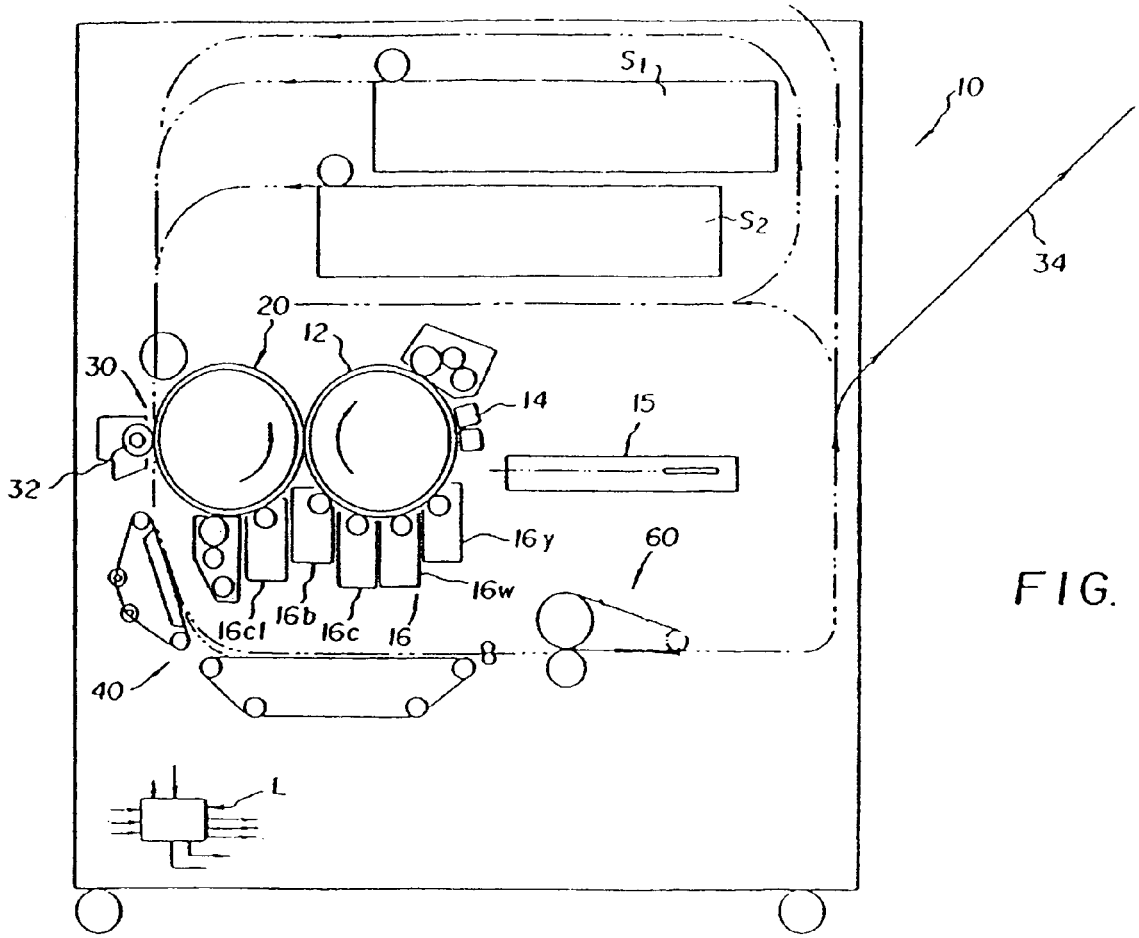
FIG. 1 is a front elevational view of an electrostatographic reproduction apparatus.

The present invention describes an overcoat layer for use on a compliant transfer intermediate member in an electrophotographic engine in which the compliant intermediate is used to drive another component of that engine such as the primary imaging member and in which the electrostatic latent image is developed into a visible image using marking particles, also referred to as toner or dry ink particles, that comprise transfer-assisting particles appended to the surface of the marking particles, whereby the transfer-assisting particles or the clusters formed by those particles have diameters between approximately 20 nm and 100 nm and preferably between 30 nm and 70 nm and more preferably between 30 nm and 50 nm.

In an electrophotographic engine, the electrophotographic processes and their individual steps have been well described in detail in many books and publications. The processes incorporate the basic steps of creating an electrostatic image, including charging and exposing a photoconductor, developing that image with charged, colored particles (toner), transferring the resulting developed image to a secondary substrate (intermediate image member), such as a cylinder with a rubber-like soft-elastic surface or a rubber blanket, and then transferred onto a final substrate or receiver and fixing or fusing the image onto the receiver. The final substrate can have an image receiving layer, also referred to as a toner receiving layer when used in an electrophotographic print engine, designed to receive the toner particles.

To fix the toner pattern to the toner receiving layer, the toner on the receiving sheet is subjected to heat and pressure, for example, by passing the sheet through the nip of fusing rolls. Both the toner polymer and the thermoplastic polymer of the toner receiving layer are softened or fused sufficiently to adhere together under the pressure of the fusing rolls. When both the toner receiving layer and the toner soften and fuse, the toner can be at least partially embedded in the thermoplastic toner receiving layer. For heat-fusible toners, thermoplastic polymers are used as part of the particle. The fusing step can be accomplished by the application of heat and pressure to the final image. Fusing can provide increased color saturation, improved toner adhesion to the receiver, and modification of the image surface texture. A fusing device can be a cylinder or belt. The fusing device can have an elastomeric coating which provides a conformable surface to enable improved heat transfer to the receiver. The fusing device can have a smooth or textured surface. The fusing step can be combined with the transfer step.

A belt fusing apparatus as described in U.S. Pat. No. 5,895,153 can be used to provide high gloss finish to the electrophotographically printed image receiving element. The belt fuser can be separate from or integral with the reproduction apparatus. When using the belt fuser as a secondary step, the toned image is at first fixed by passing the electrophotographically printed sheet through the nip of fusing rolls within the reproduction apparatus and then subjected to belt fusing to obtain a high uniform glossy finish. The belt fusing apparatus includes an input transport for delivering marking particle image-bearing receiver members to a fusing assembly. The fusing assembly comprises a fusing belt entrained about a heated fusing roller and a steering roller, for movement in a predetermined direction about a closed loop path. The fusing belt is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

Referring to FIG. 1 an electrostatographic reproduction apparatus example designated generally by numeral 10 is shown. It is readily appreciated that different configurations are possible where the intermediate member drives another component.

The apparatus 10 includes a primary imaging member, for example a drum 12, having a photoconductive surface, upon which a pigmented marking particle image or toner image or series of different color toner images is formed. In order to form images, when the photoconductive drum 12 is rotated in the direction of the arrow associated therewith, the photoconductive surface of the drum is uniformly charged, and then exposed by, for example, a laser 15 or light emitting diode (LED) array to create a corresponding latent electrostatic image. The latent electrostatic image is developed by an application of pigmented toner to the image bearing durum 12 by a development station 16. In the embodiment of the reproduction apparatus 10 as shown there a five development units, each having a particular different color toners associated respectively therewith. Specifically, developing unit 16*y* contains yellow toner, developing unit 16*m* contains magenta toner, developing unit 16*c* contains cyan toners and developing unit 16*b* contains black toner. Of course, other color toners (e.g. red, green, blue, etc) may be used in the particular developing units depending upon overall arrangement of the developing station 16 and operational characteristics of the color development scheme for the reproduction apparatus 10.

Additionally, a developing units 16c1 is provided, containing clear marking particles, which is utilized to aid in improving quality and gloss of reproduced images.

Each developer unit is separately activated for operative developing relation with drum 12 to apply different color marking particles respectively to a series of images carried on drum 12 to create a series of different color toner images. The developing toner image is transferred to the outer surface of an intermediate image transfer member, for example, an intermediate transfer drum 20. Thereafter the toner image, respectively formed on the surface of the intermediate image transfer member drum 20, is transferred in a single step to a receiver or receiver member.

The receiver member is transported along a path (designated by chain link lines) into a nip 30 between intermediate transfer member 20 and a transfer backing member 32. The receiver member is delivered from a suitable receiver member supply (hopper $S_1$ or $S_2$) into nip 30 where it receives the marking particle image. The receiving member exits the nip 30, and is transported by mechanism 40 to a fuser assembly 60 where the toner image is tacked to the receiver member by application of heat and/or pressure. After tacking the image to the receiver member, the receiver member is selectively transported, if necessary, to return to the transfer nip 30 to have a second side (duplex) image transferred to such receiver member, to a remote output tray 34 for operator retrieval, or to an output accessory.

Appropriate sensors (not shown) or any well know type such as mechanical, electrical, or optical are utilized in the reproduction apparatus 10 to provide control signals for the apparatus. Such sensors are located along the travel path of the receiver and are associated with the primary image forming member photoconductive drum 12, the intermediate transfer member 20, the transfer backing member 32 and various image processing stations. As such the sensors detect the location of a receiver in its travel path, and the position of the primary image forming member 12 in relation to the image forming process stations, and respectively produce appropriate signals indicative thereof. Such signals are fed to a logic control unit L including a microprocessor. Based on such signals and a suitable program for the microprocessor, the unit L produces signals to the control the timing operation of the various electrographic process stations for carrying out the reproduction process.

Toner size or diameter refers to the volume-weighted median diameter of spherical particles having the same mass density. The diameter of a toner is determined using commercially available equipment such as a Coulter Multisizer. In this invention, the toner should have a diameter between 4 microns and 10 microns, preferably between 4 microns and 8 microns, and more preferably between 6 microns and 8 microns. Smaller toners may prove problematical to transfer notwithstanding the teachings of this invention. Larger toners would not be sufficiently difficult to transfer so as to incur sufficient benefit from the present invention.

Transfer-assisting particles refer to particles that are known in the art that are appended to the surface of the toner particle. Suitable particles include silica, strontium titanate, barium titanate, titanium dioxide, various latex particles, etc. These particles may or may not comprise functional moieties to control tribocharging properties; surface energies, etc. It should be noted that the term "particle" is used to define the functional unit that is appended to the surface of the toner particle. In most cases, this refers to agglomerates of the fundamental transfer assisting particles. Specifically, many particles of choice may have an individual particle diameter of less than 10 nm. However, these particles exist in air as agglomerate of the fundamental particles and have diameters more in the range of 30-70 nm. The diameter of the transfer-assisting particles is determined by examining a representative toner particle (i.e. one or more from the batch of interest) in a scanning electron microscope (SEM), preferably a field emission SEM. It is strongly preferred that, when determining the size of the transfer-assisting particles on the surface of the toner particles, no conductive coating such as gold/palladium, aluminum, etc. be used on the sample as that can mask the transfer-assisting particles. Moreover, it is strongly recommended that the SEM be operated at low voltages near the unity point so that electrical charging of the particles does not occur or is at least minimized. A preferred transfer-assisting particle comprises silica.

The Young's modulus of the transfer intermediate blanket and overcoat are determined by casting separate samples of the same materials as comprise the blanket and overcoat. Here, the term "casting" is meant to mean that that sample is cast onto an appropriate form or mold and cured or otherwise treated in a similar manner to that used when a compliant intermediate transfer member is produced. After casting has been completed, the sample is removed from the form. If desired, the sample can be cut into an appropriate shape such as the dog bone shape commonly used for tensile testing of materials. The Young's modulus is determined, in tension, by applying a force to the sample using a device such as an Instron Tensile Tester and determining the stress-strain curve and extrapolating the curve back to zero stress. Other techniques of determining the Young's modulus, including nanoindentation, dynamic modulus analysis (DMA), and other known techniques are also acceptable, although the use of the Instron, as described above, is preferable when feasible.

A compliant transfer intermediate is defined as per Rimai et al. in U.S. Pat. No. 5,084,735. The blanket layer is defined as the compliant base of that intermediate and the overcoat as the thin outer skin overcoating that base.

A ceramer is defined as per Ezenyilimba et al. in U.S. Pat. No. 5,968,656.

The percent of silicate in a ceramer is determined using the following method: The inorganic content of the ceramers was determined by thermogravimetric analyses (TGA), which is described in, for example, Campbell et al., Polymer Characterization: Physical Techniques, Chapman and Hall, New York, 1989, pp 317-318. In thermogravimetric analyses, the mass of the sample is recorded continuously while the temperature is increased at constant rate. Weight losses occur when volatiles absorbed by the polymer are driven off and when degradation of the polymer occurs at high temperatures. The analyses were carried out under air purge on samples heated at a rate of 20° C./min from 25-800° C. The weight of the residues remaining at the end of the run (800° C.) was used to determine the inorganic content, SiOx, of the ceramers.

The present invention relates to an electrophotographic engine comprising an electrostatic transfer subsystem, said electrostatic transfer subsystem comprising a compliant transfer intermediate. Moreover, the compliant intermediate is used to drive, preferably by frictional coupling, at least one other subsystem such as the primary imaging member or photoreceptor, toning or development station, etc. Moreover, the toner used in this engine comprises transfer-assisting particles appended to the surface of the pigmented marking particles. The transfer-assisting particles have mean diameters between approximately 30 nm and 100 nm, preferably between 30 nm and 70 nm, and more preferably between 30 nm and 50 nm. These marking particles can comprise materials such as silica, barium titanate, titanium dioxide, strontium titanate, latex, etc. and serve principally to elevate the toner particles slightly above the primary imaging member and the compliant transfer intermediate, thereby weakening the van der Waals forces that contribute to the adhesion of the toner particles. Smaller transfer assisting particles are not suitable because they would embed too deeply into the overcoat of the transfer intermediate member described herein, thereby degrading their ability to decrease the forces of adhesion. Larger transfer-assisting particles are not allowed because they would effectively increase the size of the toner particles, thereby negating the benefits of using smaller particles. Moreover, as the adhesion forces increase with particle diameter, they could increase the adhesion of the toner particles to both the primary imaging member and the transfer intermediate, thereby impeding both transfer steps. The mean toner diameter should be between 4 microns and 10 microns, preferably between 4 microns and 8 microns, and more preferably, between 6 microns and 8 microns. Although this invention could work with larger toner particles, its value would be greatly reduced. Moreover, toner particles less than 4 microns would be too small to allow the present process to be of full benefit. The concentration of the transfer-assisting particles to the total mass of toner and transfer assisting particles depends on several factors including the size of the toner, the surface area of the toner, and the size of the silica. The surface of the toner should be coated with between 20% and 100%, preferably between 30% and 70% by the transfer-assisting particles. Percent coverage is determined using SEM micrographs. Typically, such coverage would require between approximately 0.5% and 5%. Higher percentages of the transfer-assisting particles would cause the transfer-assisting particles to form larger agglomerates, as discussed earlier in this disclosure. Lower concentrations would not be able to sufficiently elevate all portions of the toner to adequately reduce the forces of adhesion.

The thickness and Young's modulus of the blanket of the compliant transfer intermediate are disclosed in Rimai et al. (U.S. Pat. No. 5,084,735), as is the thickness of the overcoat layer. A preferred thickness of the overcoat layer is between 2 microns and 20 microns and preferably between 4 microns and 12 microns and more preferably between 4 microns and 8 microns. Thickness of the overcoat layer can be determined by cross-sectioning the compliant transfer intermediate.

An important property of the overcoat layer of the compliant transfer intermediate member is that it has a Young's modulus of between 250 and 500 MPa. If the overcoat has a lower modulus, the toner particles embed too deeply into the material as a result of either the forces of adhesion or the pressure in the transfer nip or both. This negates the value of the silica in reducing adhesion of the toner to the compliant transfer intermediate, thereby impeding transfer from the transfer intermediate member to the receiver and also impedes the ability to remove residual toner from the intermediate by cleaning. On the other hand, if the modulus is above 500 MPa, the material becomes too brittle and can crack during use due to the strains introduced by the requirement that these compliant intermediates be used to also drive other subsystems. These cracks can cause visible image artifacts and can also result in the overcoat delaminating from the compliant blanket. This particular range of Young's moduli is not inherent to any particular group of materials and is clearly a highly restricted range compared to those cited in the related art. Ceramics, refractory materials and the like have moduli that are too high and would not be suitable. Similarly, most polymers would not be suitable. Those who's glass transition temperature ($T_g$) is below the operating temperature of the electrophotographic engine would tend to be in the rubbery phase and have a Young's modulus that is too low (3 MPa). Those who's $T_g$ is above the operating temperature of the electrophotographic engine would tend to have a Young's modulus that is too high (3 GPa) and are too brittle. Polymers operating near their $T_g$ might have the correct elastic modulus and might be suitable under some conditions. However, in this temperature range, the Young's modulus can change by orders of magnitude with a small temperature change. Accordingly, the temperature of the electrophotographic engine would have to be tightly controlled. This is difficult to do.

Although this patent revolves around the physical properties of materials rather than specific classes themselves, there are some general classes of materials that, although the properties disclosed herein are not inherent to those classes of materials, specific ranges of compositions can be produced that have the necessary properties. These classes include materials such as ceramers, sol-gels, and the like. A preferred class of materials includes various ceramers. Although the Young's modulus is a function of properties such as the molecular weight of the polymer used to produce the ceramer, ceramer compositions whose silicate fraction ranges between 32% and 41% will have the appropriate Young's modulus and constitute a preferred material. The silicate composition can be determined using standard chemical analysis techniques such as TGA described previously in this disclosure.

In a preferred embodiment of an electrophotographic engine utilizing this invention, there are a plurality of imaging stations, each comprising a primary imaging member, a development station, cleaning stations, LED or laser scanner writers, etc., as well as a compliant transfer intermediate. Each station produces an image of a distinct color such as the cyan. magenta, yellow, and black images of a process-color print. Additional stations and colors can also be used. Each intermediate drives the primary imaging member within its own station and is, in turn, frictionally driven by a receiver transport web that transports receiver sheets past each compliant intermediate in a sequential fashion. The toner-bearing receiver is then transported to a fusing station where heat and pressure permanently fix the image to the receiver.

EXAMPLE 1

An 8 micron polyester toner comprising approximately 1.33% silica. SEM micrographs of the toner show that the mean diameter of the silica clusters appended to the surface of the toner is approximately 50 nm. The charge-to-mass ratio of the toner, as determined using the technique of Miskinis ((E. T. Miskinis, Proc. 6th International Congress on Non-Impact Printing, IS&T, Springfield, Va., 1990, pp. 101-110) was found to be $-32.3\times10^{-6}$ C/g, corresponding to a particle charge of $7.1\times10^{-15}$ Coulombs. The maximum applied electrostatic force that can be exerted on that particle during transfer is approximately 220 nN, due to Paschen discharge, as discussed by Rimai et al. (D. S. Rimai, D. S. Weiss, and D. J. Quesnel, J. Adhesion Sci. Technol. 17, 917-942 (2003)). In other words, if the force of adhesion to the intermediate for this particle were greater than 220 nN, it would not be possible to rely on electrostatics alone to transfer the particle. Rather, there would need to be an additional force such as a balancing surface force. This would require the use of a smooth compliant intermediate, such as disclosed by Zaretsky.

In this example, the toner was electrostatically deposited onto a nickelized support that was overcoated with a ceramer having a Young's modulus of 153 MPa and a silicate concentration, as determined by TGA of 30%. This is outside the specification of this invention. The force needed to overcome the adhesion, as measured using ultracentrifugation, was 290 nN, which is too high. Experimental confirmation obtained on an electrophotographic engine such as described in this disclosure showed poor transfer.

EXAMPLE 2

This was similar to example 1 except that the ceramer had a Young's modulus of 299 MPa and a silicate concentration of 35%. This is within the specifications of this invention. The adhesion force was 190 nN and transfer efficiency was good. In addition, no cracking was found when running in an electophotographic engine such as described in this disclosure.

EXAMPLE 3

This was similar to example 1 except that the ceramer had a Young's modulus of 413 and silicate concentration of 38.5%. This material is within the specifications of this patent. The measured adhesion force was 170 nN. Transfer efficiency was good and no cracking of the ceramer layer occurred.

EXAMPLE 4

This example was similar to example 1 except that the ceramer had a Young's modulus of 757 MPa and a silicate concentration of 41.4%. This example has too high an elastic modulus and silicate concentration and is, therefore, outside the specifications of this invention. The detachment force was 140 nN, which would imply that the transfer efficiency should be good. However, when actually running this material in an electrophotographic engine as described in this disclosure, the ceramer was found to crack and be unacceptable.

EXAMPLE 5

This example is similar to example 1 except that the ceramer had a Young's modulus of 74 MPa and a silicate concentration of 30.7%. These values are too low and are outside the range of the present invention. The detachment force was measured to be 373 nN. This is greater than the maximum electrostatic force that could be applied and poor transfer efficiency was found, although no cracking of the ceramer occurred.

EXAMPLE 6

This example is similar to example 1 except that the ceramer had a Young's modulus of 227 MPa and a silicate concentration of 35.1%. The detachment force was found to be 205 nN. This is very close to the maximum electrostatic transfer force that can be applied and gives little latitude for variations that can occur due to charge variations, developer aging, or variations that occur during manufacture. Such variations can readily result in poor transfer and suggests that using a ceramer with this low a modulus would not make for a robust machine. No cracking of the ceramer with usage was observed.

EXAMPLE 7

This example is similar to example 1 except that the ceramer had a Young's modulus of 378 MPa and a silicate concentration of 40.1%. This material is within the specifications of this invention. The detachment force was found to be 170 nN and transfer efficiency was good. No cracking of the ceramer with usage was observed.

EXAMPLE 8

This example was similar to example 1 except that the ceramer had a Young's modulus of 1395 MPa and a silicate concentration of 42.7%. This example has too high an elastic modulus and silicate concentration and is, therefore, outside the specifications of this invention. The detachment force was 90 nN, which would imply that the transfer efficiency should be good. However, when actually running this material in an electrophotographic engine as described in this disclosure, the ceramer was found to crack and be unacceptable.

The invention has been described with reference to a preferred embodiment. However, it will be appreciated that variations and modifications can be effected by a person of ordinary skill in the art without departing from the scope of the invention.

The invention claimed is:

1. A method of forming a toner image on a receiving sheet, comprising:

forming an electrostatic image on a primary image member;

toning said image with a dry toner to form a toner image, said toner comprising toner particles having a diameter of between 4 and 10 microns and transfer assisting particle agglomerates appended to a surface of said toner particles, said transfer assisting particle agglomerates having a diameter of between 20 and 100 nm;

transferring said toner image from said primary image member to an intermediate image member having an overcoat layer, said overcoat layer having a Young's modulus of from 250 to 500 MPa; and transferring said toner image from said intermediate image member to a receiving sheet wherein said intermediate image member drives said primary image member or said receiving sheet;

wherein said overcoat layer comprises a ceramer comprising between 32% and 41% silicate fraction.

2. The method of claim 1 wherein the toner particles have a diameter of between 4 and 8 microns.

3. The method of claim 1 wherein the toner particles have a diameter of between 6 and 8 microns.

4. The method of claim 1 wherein the transfer assisting particle agglomerates comprise silica, strontium titanate, barium titanate, titanium dioxide or latex.

5. The method of claim 1 wherein the said transfer assisting particle agglomerates have a diameter of between 30 and 70 nm.

6. The method of claim 1 wherein the surface of the toner particle is between 20% and 100% covered with transfer assisting particle agglomerates.

7. The method of claim 1 wherein the overcoat layer of said intermediate image member has a thickness of between 2 and 20 microns.

* * * * *

UNITED STATES PATENT AND TRADEMARK OFFICE

CERTIFICATE OF CORRECTION

PATENT NO. : 7,488,563 B2
APPLICATION NO. : 11/250224
DATED : February 10, 2009
INVENTOR(S) : Kapusniak et al.

It is certified that error appears in the above-identified patent and that said Letters Patent is hereby corrected as shown below:

Title Page of Patent:

At section (56) References Cited,

Replace

"5,087,393 A * 2/1992 (Guest et al. .....399/167)" with

--5,087,939 A * 2/1992 (McDougal .....399/167)--.

Signed and Sealed this

Ninth Day of June, 2009

JOHN DOLL
*Acting Director of the United States Patent and Trademark Office*